United States Patent [19]

Nimmey et al.

[11] Patent Number: 4,927,058

[45] Date of Patent: May 22, 1990

[54] PACKAGE FOR A FLOWABLE MATERIAL SUSCEPTIBLE TO FLAVOR LOSS

[75] Inventors: Alan Nimmey, Sale; Harry Hayes, Warrington, both of England

[73] Assignee: Colgate-Palmolive Company, Piscataway, N.J.

[21] Appl. No.: 221,768

[22] Filed: Jul. 20, 1988

[51] Int. Cl.[5] ..... B65D 35/08; B65D 35/14

[52] U.S. Cl. ..... 222/106; 222/107; 222/564

[58] Field of Search ..... 222/92, 106, 107, 460, 222/464, 564

[56] References Cited

U.S. PATENT DOCUMENTS

| | | | |
|---|---|---|---|
| 1,760,773 | 5/1930 | Penney | 222/92 |
| 2,332,414 | 10/1943 | Tome | 222/92 |
| 2,775,369 | 12/1956 | Waite | 222/92 |
| 3,285,479 | 11/1966 | Porter et al. | 222/564 |
| 4,474,313 | 10/1984 | Sieverding | 222/464 |

*Primary Examiner*—Joseph J. Rolla
*Assistant Examiner*—Steve Reiss
*Attorney, Agent, or Firm*—Richard J. Ancel; Robert C. Sullivan; Murray M. Grill

[57] ABSTRACT

A package comprising, an elongated collapsible tube defining a chamber to receive a flowable material, with the tube having a tapered shoulder, and a hollow neck having an inner end extending from the shoulder, and an outer end. The shoulder normally causes flavor loss of the material in the region of the chamber adjacent the shoulder. The package has an insert comprising a tubular section having an outer end connected to the neck, and an inner end extending into the chamber a sufficient distance to prevent extrusion of the material in the region of the shoulder through the neck.

13 Claims, 1 Drawing Sheet

PACKAGE FOR A FLOWABLE MATERIAL SUSCEPTIBLE TO FLAVOR LOSS

BACKGROUND OF THE INVENTION

The present invention relates to a package for a flowable material which is susceptible to flavor loss.

The use of collapsible or squeezable tubes for a flowable material, such as a dental cream, is known. The tubes normally define a chamber, have a tapered shoulder, and have a neck extending from the shoulder. The tubes are normally constructed from a laminate, such as polyethylene, aluminum foil, paper, and polyethylene. Although the tubes operate satisfactorily in dispensing the material, it has been found that the material is subject to flavor loss in the region of the shoulder.

The normal solution to this problem has been to use plastic in the tube with enhanced flavor barrier properties. However, these materials are generally expensive, particularly since separate moldings are necessary, and bonding is required between these barrier materials and the normal shoulder of the tube.

SUMMARY OF THE INVENTION

A principal feature of the present invention is the provision of an improved package for a flowable material susceptible to flavor loss.

The package of the present invention comprises, an elongated collapsible tube defining a chamber to receive the material, with the tube having a tapered shoulder, and a hollow neck having an inner end extending from the shoulder, and an outer end. The shoulder normally causes flavor loss in the material in the region of the chamber adjacent the shoulder. The package has an insert comprising a tubular section having an outer end connected to the neck, and an inner end extending into the chamber.

A feature of the present invention is that the inner end of the tubular section extends a sufficient distance into the chamber to prevent extrusion of the material in the region of the shoulder through the neck.

Thus, a feature of the present invention is that the package accepts flavor loss in the shoulder area of the tube, but prevents the material affected by the flavor loss from being extruded from the tube.

Another feature of the present invention is that the package may be constructed in a simplified manner, and at a reduced cost.

Further features will become more fully apparent in the following description of the embodiments of this invention and from the appended claims.

DESCRIPTION OF THE PREFERRED EMBODIMENTS

Figure 1:
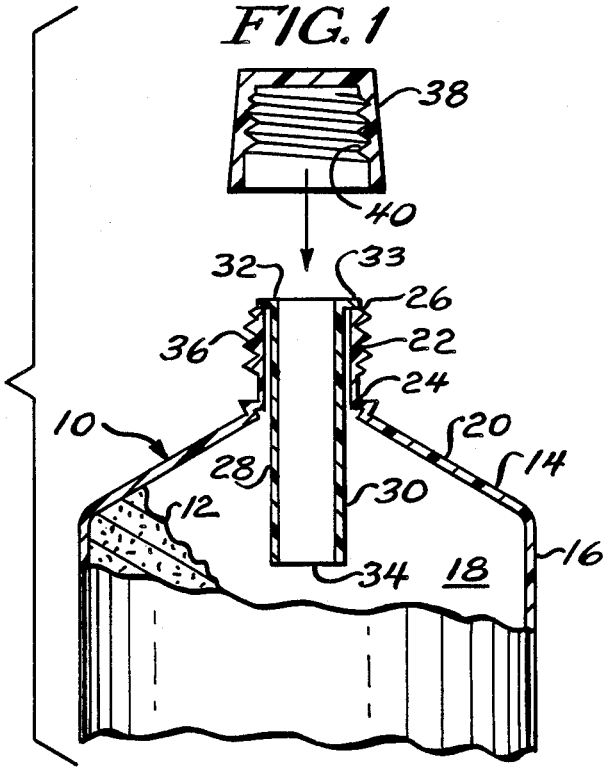
FIG. 1 is a fragmentary sectional view of an embodiment of a tube of the present invention.

Referring now to FIG. 1, there is shown a package generally designated 10 for a flowable material 12, such as dental cream, which is susceptible to flavor loss.

The package 10 comprises an elongated collapsible tube 14 having a body poriton 16 of a laminate material, such as polyethylene, aluminum foil, paper, and polyethylene, with the tube 14 defining an elongated chamber 18 to receive the material 12. The tube 14 has a tapered shoulder 20, and a hollow neck 22 having an inner end 24 extending from the shoulder 20, and an outer end 26. The shoulder 20 normally causes flavor loss in the material 12 in the region of the chamber 18 adjacent the shoulder 20.

The package 10 has an insert 28 comprising an elongated tubular section 30 having an outer end 32 having an outwardly directed annular flange 33 connected to the outer end 26 of the neck 22, such as by adhesive, with the tubular section 30 being located inside and spaced from the neck 22. The tubular section 30 has an inner end 34 extending into the chamber 18 to a location past the shoulder 20. In this embodiment, the tubular section 30 is of uniform diameter between the outer end 32 and the inner end 34.

As shown, the outer surface of the neck 22 has threads. The package 10 has a cap 38 with inner threads 40 which cooperate with the threads 36 of the neck 22, such that the cap 38 may be secured to the neck 22 and close the neck 22.

In use, when the body portion 16 of the tube 14 is squeezed, the material 12 passes through the tubular section 30 to a location outside the tube 14 for use. At the same time, the tubular section 30 prevents the extrusion of the material 12 located in the region of the shoulder 20 past the neck 22, in order to prevent passage of material 12 through the neck 22 which is subject to flavor loss. The insert 28 may be constructed from any suitable plastic material, such as polypropylene, nylon, or polyurethane, which does not cause flavor loss in the material 12.

Figure 2:
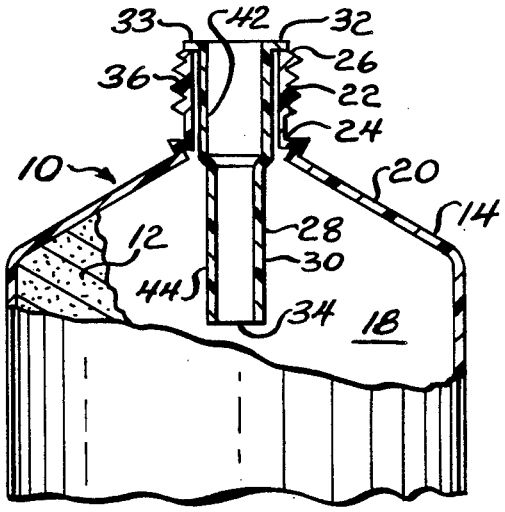
FIG. 2 is a fragmentary sectional view of another embodiment of the tube.

Another embodiment of the present invention is illustrated in FIG. 2, in which like reference numerals designate like parts. In this embodiment, the tubular section 30 has an outer end portion 42 of a first diameter, and an inner end portion 44 of a second diameter which is smaller than the first diameter of the outer end portion 42. The inner end portion 44 is joined to the outer end portion 42 at a location in the region of the inner end 24 of the neck 22. The tube 14 of FIG. 2 operates in a manner as previously discussed in connection with the tube 14 of FIG. 1 to prevent extrusion of material 12 from the tube 14 having a flavor loss.

Figure 3:
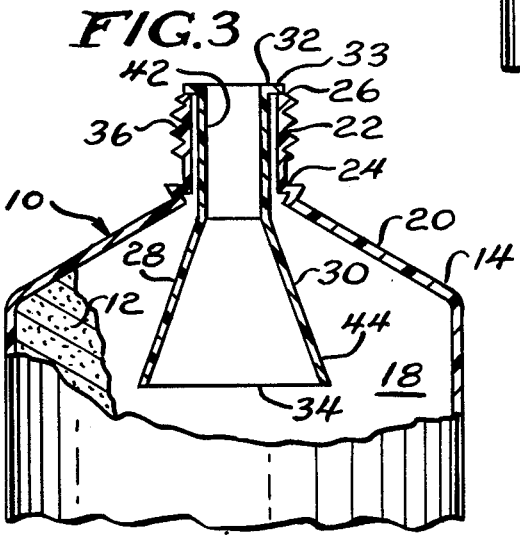
FIG. 3 is a fragmentary sectional view of another embodiment of the tube of the present invention.

Another embodiment of the present invention is illustrated in FIG. 3, in which like reference numerals designate like parts. In this embodiment, the outer end portion 42 inside the neck 22 has a uniform diameter, while the inner end portion 44 is outwardly flared in the chamber 18. The inner end portion 44 is joined to the outer end portion 42 at a location adjacent the inner end 24 of the neck 22. The tube 14 of FIG. 3 operates in a manner as previously discussed to prevent the extrusion of material 12 from the tube 14 which is subject to flavor loss.

The foregoing detailed description is given for clearness of understanding only, and no unnecessary limitations should be understood therefrom, as modifications will be obvious to those skilled in the art.

We claim:

1. A package for a flowable material susceptible to flavor loss, comprising;

an elongated collapsible tube defining a chamber to receive the material, said tube having a body portion and a tapered shoulder extending from the body portion, and a hollow neck having an inner end extending from the shoulder, and an outer end, said shoulder being in contact with the material and normally causing flavor loss of the material in the region of the chamber adjacent the shoulder with the body portion, neck and shoulder being of one-piece construction; and an insert separate from the tube and comprising a tubular section having an outer end connected to the outer end of the neck, and an inner end extending into the chamber a sufficient distance to prevent extrusion of the material in the region of the shoulder through the neck.

2. The package of claim 1 wherein said tubular section has an outer end portion located inside of the neck.

3. The package of claim 2 wherein the outer end portion of the tubular section has a first diameter, and in which the tubular section has an inner end portion of a second diameter smaller than the first diameter.

4. The package of claim 3 wherein the inner end portion of the second diameter is joined to the outer end portion of the first diameter adjacent the region of the inner end of the neck.

5. The package of claim 2 wherein the tubular section has a uniform diameter.

6. The package of claim 2 wherein the outer end portion of the tubular section is spaced from the neck.

7. The package of claim 1 wherein the tubular section has an outwardly flared inner end portion.

8. The package of claim 7 wherein the flared inner end portion is connected to the outer end portion adjacent the region of the inner end of the neck.

9. The package of claim 1 including a cap, and means for securing the cap to the neck.

10. The package of claim 9 wherein an outer surface of the neck and an inner surface of the cap contain cooperating threads.

11. The package of claim 1 wherein the inner end of the insert extends past the shoulder.

12. The package of claim 1 wherein said insert comprises polypropylene or nylon.

13. The package for a flowable material susceptible to flavor loss, comprising:

an elongated collapsible tube defining a chamber to receive the material, said tube having a body portion and a tapered shoulder extending from the body portion, and a hollow neck having an inner end extending from the shoulder, said body portion, shoulder, and neck being of one-piece construction, and an outer end, said shoulder being in contact with the material and normally causing flavor loss of the material in the region of the chamber adjacent the shoulder; and an insert separate from the tube and comprising a tubular section having an outer end connected to the outer end of the neck with said tubular section being located inside and spaced from the neck, said tubular section having an inner end extending into the chamber to a location past said shoulder to prevent extrusion of the material in the region of the shoulder past the neck.

* * * * *